US005560605A

United States Patent [19]

Garcia et al.

[11] Patent Number: 5,560,605

[45] Date of Patent: Oct. 1, 1996

[54] STRATEGY GAME

[76] Inventors: Filadelfo Garcia; Lazaro R. Sanchez, both of 4172 Gertrude St., Simi Valley, Calif. 93063

[21] Appl. No.: 460,658

[22] Filed: Jun. 2, 1995

[51] Int. Cl.[6] ..... A63F 9/08

[52] U.S. Cl. ..... 273/153 P

[58] Field of Search ..... 273/153 P, 287, 273/241; 446/117; 434/259, 204, 403, 200

[56] References Cited

U.S. PATENT DOCUMENTS

| | | | |
|---|---|---|---|
| D. 225,543 | 12/1972 | Hardesty | 273/153 P X |
| 303,946 | 8/1884 | Ohlert | 273/153 P X |
| 526,908 | 10/1894 | Parker et al. | 273/287 |
| 2,395,174 | 2/1946 | Drueke | 273/287 |
| 2,595,938 | 5/1952 | Grant | 273/153 P |
| 2,738,979 | 3/1956 | Dalton | 273/153 P |
| 4,043,561 | 8/1977 | Stepansky | 273/153 P |

FOREIGN PATENT DOCUMENTS

| | | | |
|---|---|---|---|
| 177097 | 5/1953 | Austria | 273/153 P |
| 803521 | 4/1951 | Germany | 273/153 P |
| 23477 | of 1914 | United Kingdom | 273/153 P |

OTHER PUBLICATIONS

Games, Nov. 1982, p. 70, The Temple of Hanoi.

*Primary Examiner*—Paul E. Shapiro
*Attorney, Agent, or Firm*—Albert O. Cota

[57] ABSTRACT

A strategy game (10) that incorporates a stationary platform (12) that includes a set of three peg cavities (26) into which are inserted a set of three pegs (40), and a set of seven disks (52) each having a different diameter. The game is initially started by stacking the set of seven disks (52) on one of the pegs (40) with the largest diameter disk on the bottom and the smallest diameter disk on the top. The object of the game (10) is to move the stack of disks (52) from the one peg to another peg in the least amount of strategy moves and/or time. All moves must be accomplished without placing a disk having a larger diameter over a disk of smaller diameter.

1 Claim, 4 Drawing Sheets

STRATEGY GAME

TECHNICAL FIELD

The invention pertains generally to strategy games that are played by one or two players and more particularly to a game consisting of a stationary platform having upright pegs and a set of disks that are strategically placed and orderly stacked on the pegs.

BACKGROUND ART

The field of recreational board games that competitively match suits with one another along with the element of chance has always been intriguing. This intrigue is enhanced when the game is complicated enough to require strategy and thought to complete the game is less moves and/or in a shorter time than a competing player. Further moves may be planned well in advance requiring thought and tactical strategy.

There are currently many types of games that can be played by two players using the principle of placing objects on a board or similar structure with the purpose of aligning a series of objects in a vertical or horizontal row. As an example, checkers is played on a board having alternately dark and light colors using opposed sets of pieces and has enjoyed popularity for centuries. Other similar games include two and three dimensional tick-tack-toe. The three dimensional tick-tack-toe employs the same basic principle as the two dimensional game except it uses a series of stacked transparent boards achieving an alignment of pieces in the third dimension.

The instant invention allows a game to be competitively played by either one person against another person, or a plurality of persons which share in selecting the strategy of the next move. The prior art disclosed games with structures using similar principles. However, these prior-art games have limitations in that most must be played with at least two players and the rules and strategy for playing the game differ from those of the instant invention.

A search of the prior art did not disclose any patents that read directly on the claims of the instant invention. However, the following U.S. patents were considered related:

| U.S. Pat. No. | INVENTOR | ISSUED |
|---|---|---|
| 2,485,143 | Duncan | 18 October 1949 |
| 3,556,526 | Currie | 19 January 1971 |
| 3,561,774 | Brinser | 9 February 1971 |
| 4,119,320 | Chorba et al | 10 October 1978 |
| 4,979,748 | Danielak et al | 25 December 1990 |

The Duncan 2,485,143 patent discloses a three dimensional tick-tack-toe game with pawns having a socket on the top and a stem on the bottom. The game is played with a square board having nine holes and opposing pawns are placed one on top of the other until, three pawns in a row are aligned.

The Currie 3,556,526 patent discloses a board game having eight upstanding pegs and a set of tokens. Each opponent set has opposite magnetic poles thus positioning the tokens in an interspacial array on the poles. The object of the game is to align three like tokens.

The Brinser 3,561,774 patent discloses a board game having nine support members and a set of tokens. The support members are uprightly mounted and have three different diameters and the playing tokens are also in sets of three diameters each complimentary with the other. The object of the game is to align like tokens.

The Chorba et al 4,119,320 patent discloses a game with a triangular board and nine elongated pegs placed in rows of three discrete groupings. The playing pieces have a hole allowing accommodation by the pegs. A wild piece having a separate color is used in play and the three dimensional alignment is used as the object of the game.

The Danielak et al 4,979,748 patent discloses a token aligning three-dimensional strategy game using five aligned tubes with an opaque upper portion and a transparent lower portion. Tokens are alternately placed in the tubes and a pin is pulled dropping the balls into the transparent section. The object of the game is to align the hidden tokens in a row.

Games that utilize a set of playing pieces placed alternately over pegs to achieve alignment is well known in the art. However, a game that begins with several disks stacked on a first peg in a pyramid configuration that must be moved from the first peg to a second peg by a series of strategic moves was not found in the prior art patents.

For background purposes and as indicative of the art to which the invention relates, reference may be made to the following remaining patents found in the search:

| PATENT NO. | INVENTOR | ISSUED |
|---|---|---|
| 4,977,941 | Henderson | 18 December 1990 |
| 4,239,230 | Shoptaugh | 16 December 1980 |
| 2,100,280 | Goldberger | 23 November 1937 |

DISCLOSURE OF THE INVENTION

The strategy game disclosed herein is designed to be played by either one of more players. The object of the game is to move a set of seven segments that are placed over a first peg to a second peg in the least amount of moves and/or time. In its most basic form, the strategy game consists of 1. A horizontal stationary platform having a set of at least three spaced-apart peg cavities.
2. A set of at least three pegs with a peg inserted upright into each of the at least three peg cavities, and
3. A set of seven movable segments. Each segment has a bore therethrough sized to slidably pass through the pegs and each segment has a different outward dimension. Preferably each segment has a different color or is numbered.

To start the game, the segments are initially stacked one atop the other over one of the at least three pegs, with the segment having the largest outward dimension being at he bottom of the stack. The remaining segments are also stacked over the same peg with the next largest dimensioned segment and sequentially concluding with the smallest dimensioned seventh segment located on top of the stack. The game is played by performing a series of strategy moves that concludes when the seven segments stacked on one of the at least three pegs are moved and identically stacked over another of the at least three pegs. All moves are accomplished without placing a larger dimensioned segment over a smaller dimensioned segment.

In the preferred embodiment of the game, a set of three pegs are utilized with the seven segments which provide a maximum degree of difficulty in playing the game. A less difficult game can be designed by using four pegs that are placed with the seven segments. This less difficult game which is appropriate for children can be completed in twenty-seven (27) moves as compared to the one-hundred forty-seven (147) moves that are required to complete the game with the three pegs.

The preferred shape of the horizontal stationary platform is rectangular, however, other shapes such as a square, an isosceles triangle or a circle can also be employed. In addition, the platform can be made as an enclosure that includes a front section having an opening. The opening is dimensioned to accept a drawer that is sized to allow the three pegs and seven segments to be stored when the game is not in use.

In a deluxe model of the strategy game, an electrical circuit can be incorporated into the platform. The circuit includes a light bulb that is powered by a battery, and a sensitive switch that when closed applies the battery power to the light bulb. The switch includes a contact arm that is located on the top surface of the enclosure just below the disk stack. When a weighted seventh segment or disk is place atop the stack, the weight of the stack causes a plunger to close the switch contacts causing the light bulb to illuminate indicating that the game has been completed.

In view of the above disclosure, it is the primary object of the invention to produce a game that requires a series of strategy moves to win the game. The game structure includes a platform having a set of three pegs that on one of the pegs is inserted a stack of seen disks with each having a different diameter. The object of the game is to move the stack form the one peg to another peg in the least amount of moves.

Another primary object of the invention is to keep the rules simple enough to learn easily so as not to be discouraging and yet be able to be challenging during the period of play.

An important object along with the simple rules is directed toward the ability of all ages to learn the game quickly making the initial challenge not mastering the rules but the but the strategies and tactics required in order to win the game.

Still another object of the invention basically eliminates arbitrary judgments and controversial decisions while playing the game, as the rules are simple, concise and when a segment is dropped, the move is irrevocably made.

Yet another object of the invention is simplicity to fabricate the apparatus and yet it has eye appealing symmetrical artistic qualities as the base and board may be made of wood or some type of thermoplastic that has a texture or grain attractively appealing to the users.

These and other objects and advantages of the present invention will become apparent from the subsequent detailed description of the preferred embodiments and the appended claims taken in conjunction with the accompanying drawing.

BEST MODE FOR CARRYING OUT THE INVENTION

The best mode for carrying out the strategy game 10 is presented in terms of a preferred embodiment and a second embodiment. Both embodiments are designed to allow a single player or a plurality of players, by a series of strategy moves, to move a stack of pre-arranged segments from one peg location to another peg location.

The preferred embodiment as shown in FIG. 1–13 is comprises of three major elements, a horizontal stationary platform 12, a set of three pegs 40 and a set of seven movable segments 50.

Figure 1:
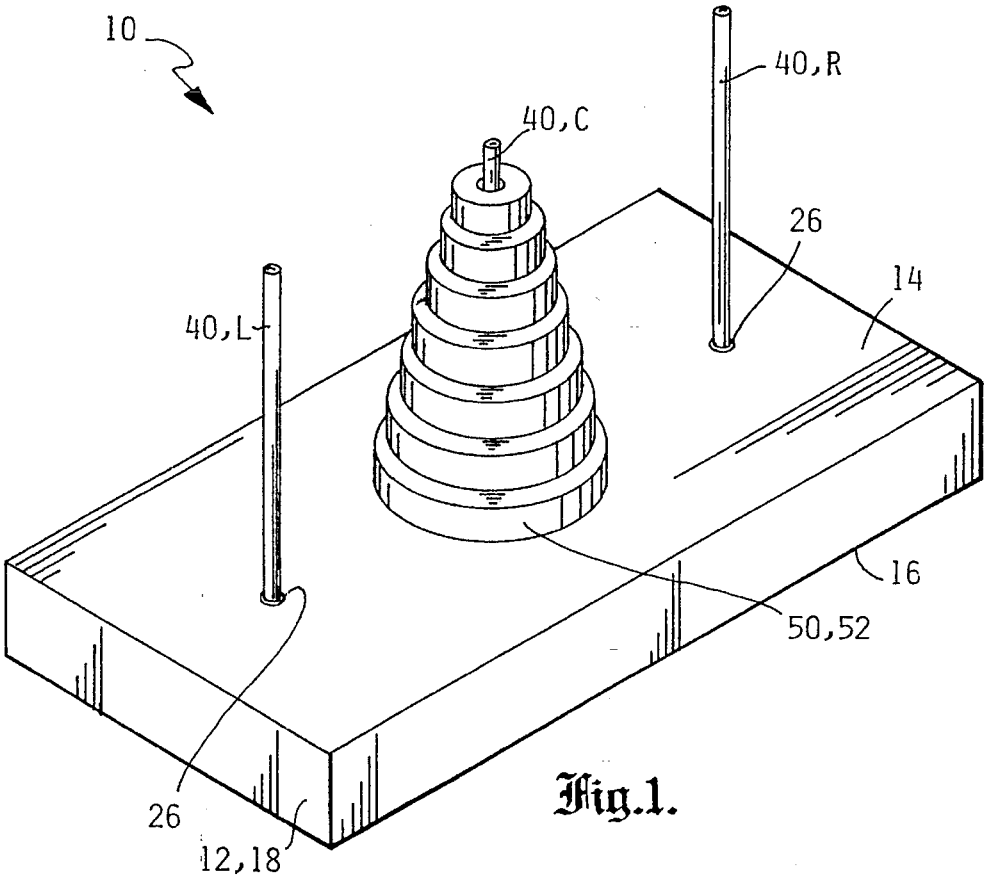
FIG. 1 is a perspective view of the strategy game that incorporates a rectangular stationary platform incorporating three pegs and a stack of seven disks.

The horizontal stationary platform 12 as shown in its basic form in FIG. 1 has a flat upper surface 14 and a flat lower surface 16 that is sized to be stale when placed on a flat surface such as a table or floor. On the upper surface 14 of the platform 12 are located a set of three spaced-apart peg cavities 26. The stationary platform 12 can be made in various shapes with a rectangular shape 18 as shown in FIG. 1.

In the rectangular shaped platform 12 a set of three peg cavities are equally spaced and centered across the longitudinal length of the platform. The three cavities are referred to as a center cavity, a left cavity and a right cavity where the center cavity is located between the left cavity and the right cavity. Into the respective cavities is inserted upright, a center peg (C) a left peg (L) and a right peg (R). In all cases, the pegs 40 have a length that allows the seven segments to be inserted and held within the peg. Also, in both embodiments of the game, the platform 12, pegs 40 and the seven segments can be constructed of any material such as plastic, wood or a metal. For aesthetic and quality look, a wood is preferred for all the elements.

Figure 2:
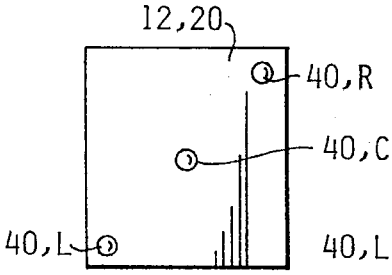
FIG. 2 is a plan view of a stationary platform having a square shape.
Figure 3:
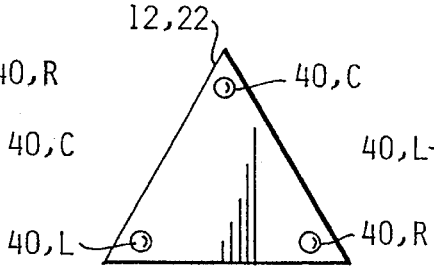
FIG. 3 is a plan view of a stationary platform having an isosceles triangle shape.
Figure 4:
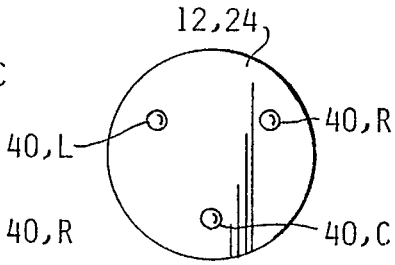
FIG. 4 is a plan view of a stationary platform having a circular shape.

In addition to the preferred rectangularly shaped platform 12, 18 as shown in FIG. 1, the platform can also be made in the shape of a diamond or square 20 as shown in FIG. 2, an isosceles triangle 22 as shown in FIG. 3, or in a circle 24 as shown in FIG. 4. In the diamond or square shaped platform 12, 20, the center cavity is located in the center of the diamond or square 20 and the left and right cavities are located on two opposite diagonal corners of the diamond or square 20. In the isosceles triangle shaped platform 12, 22, the center cavity is located near the edge of the upper apex 22A and the left and right cavities are located respectively near the edges of the left apex 22B and the right apex 22O.

In the circular shaped platform 12, 24 the center, left and right cavities are equally spaced near the perimeter of the circular platform 24.

Figure 5:
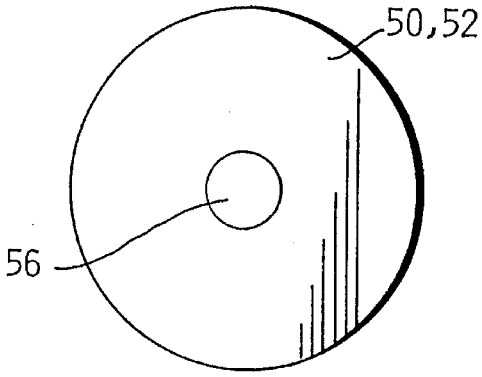
FIG. 5 is a plan view of a circular disk.
Figure 7:
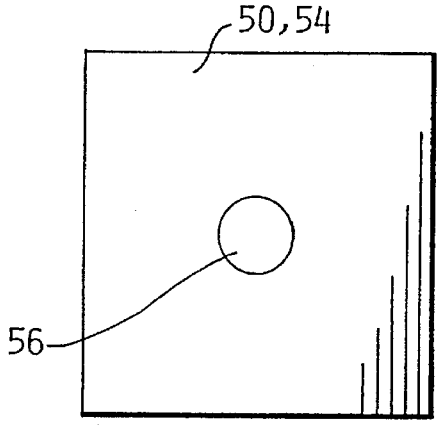
FIG. 7 is a plan view of a square segment.
Figure 6:
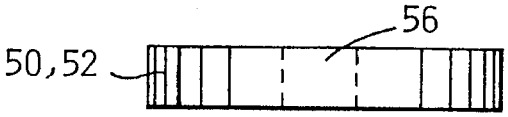
FIG. 6 is an elevational view of the circular disk of FIG. 5.
Figure 8:
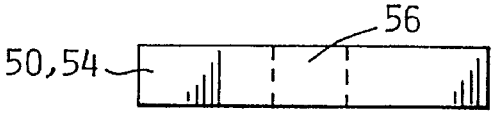
FIG. 8 is a plan view of the square segment of FIG. 7.
Figure 9:
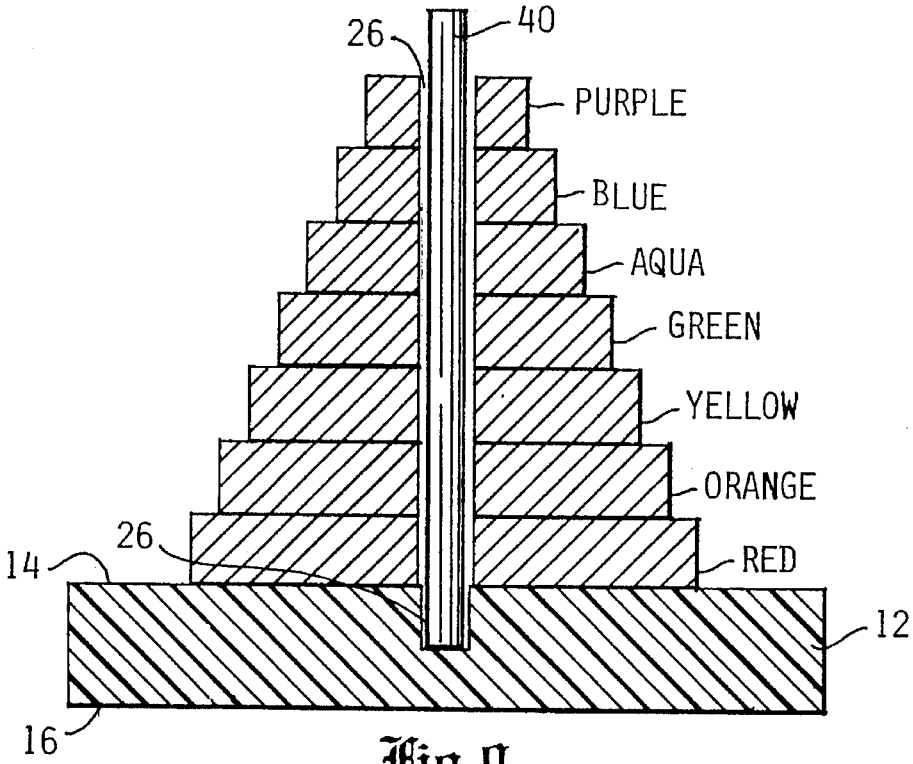
FIG. 9 is a side elevational view of a platform having a peg on which is inserted a set of seven disks.

The seven movable segments 50 that are used to provide the strategy moves are preferably constructed as a circular disk 52 as shown in FIGS. 5 and 6. However, other shapes such as a square 54 as shown in FIGS. 7 or 8 can also be used. Each of the segments as shown in FIG. 5–9 has a substantially centered bore 56 therethrough that is sized to slidably pass through the pegs 40 and each segment 50 has a different dimension or diameter in the case of the preferred circular disk 52. When the disks 52 are stacked over a peg 40, as in the beginning or conclusion of the game, the disk 52 wit the largest diameter is located at the bottom of the stack. The remaining six disks 52 are than stacked over the peg 40 commencing with the next largest diameter disk 52 in a descending diameter order until the disk 52 with the smallest diameter is located at the top of the stack as shown in FIG. 9.

For aesthetics and to facilitate the game instructions, each of the seven segments 50 or circular disks 52 are preferably made in different colors. In the preferred color scheme, the largest diameter disk 52 located at the bottom of the stack is red. Progressing upwards on the stack, the disks are orange, yellow, green, aqua, blue and conclude with a purple disk 52 located at the top of the stack as shown in FIG. 9. Alternatively or in addition to the color scheme, the disks 52 may also be sequentially numbered. In the numbering sequence, the largest dimensioned segment 50 which is located at the bottom of the stack, is assigned the number 7 and the smallest dimensioned segment, located at the top of the stack is assigned the number 1 as also shown in FIG. 9.

Figure 10:
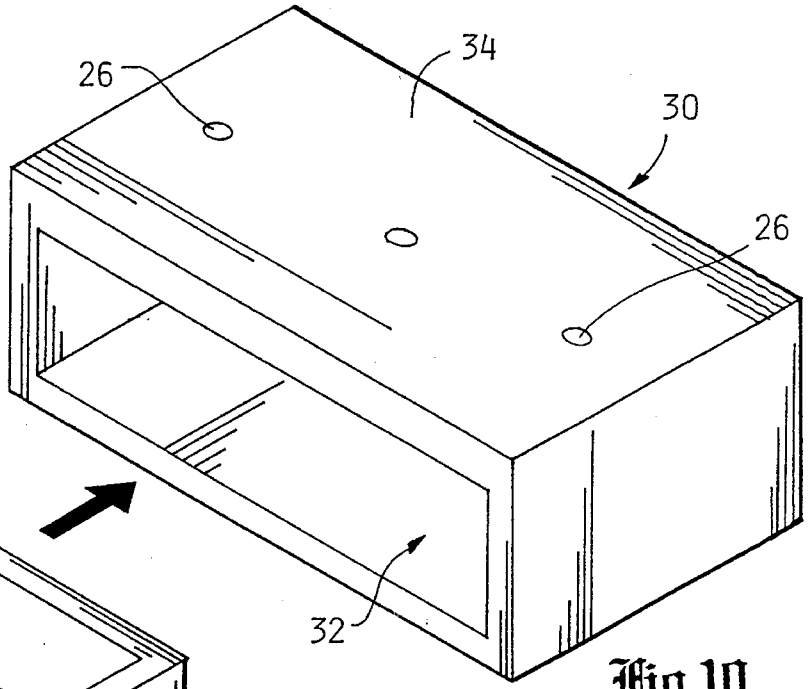
FIG. 10 is a perspective view of an enclosure that includes a set of three peg cavities and a front drawer cavity.
Figure 11:
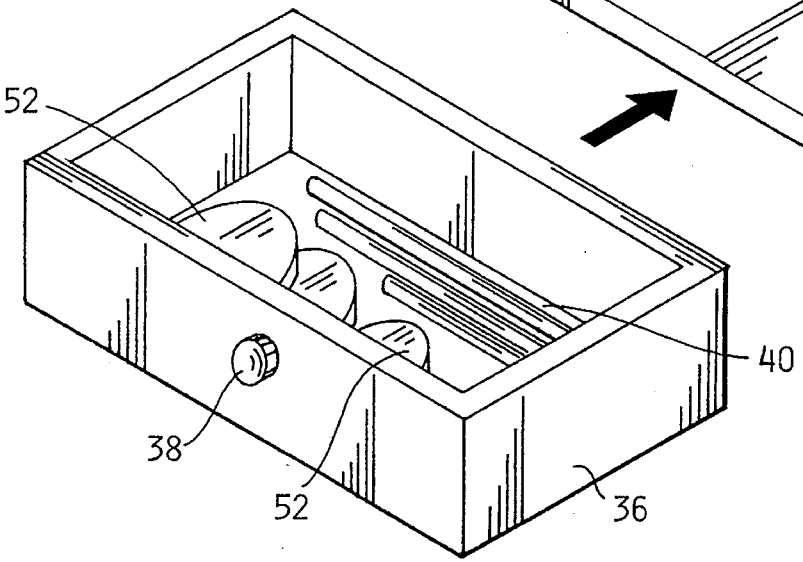
FIG. 11 is a perspective view of a drawer that fits into the front drawer cavity and that is sized to allow the three pegs and seven disks to be stored when the game is not in use.

To enhance the utility of the game 10, the stationary platform 12 may be further comprised of an enclosure 30 that includes a front drawer cavity 32 and an upper surface 34 having three equally spaced peg cavities 26 as shown in FIG. 10. The enclosure incorporates a drawer 36 as shown in FIG. 11 that is dimensioned to slidably traverse through the front drawer cavity 32. The drawer includes a handle 38 and is sized to allow the three pegs 40 and the seven disks 52 to be stored when the game 10 is not in use.

Figure 12:
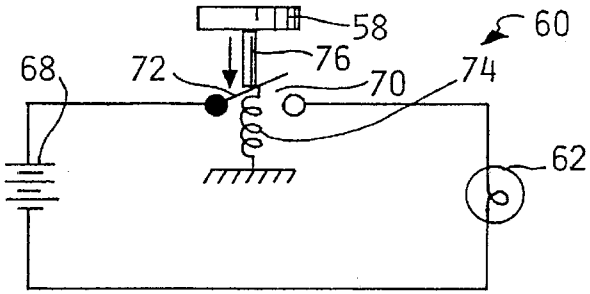
FIG. 12 is a schematic diagram of an electrical circuit that causes a light bulb to illuminate when the game has been completed which occurs when the last disk is placed on a peg.
Figure 13:
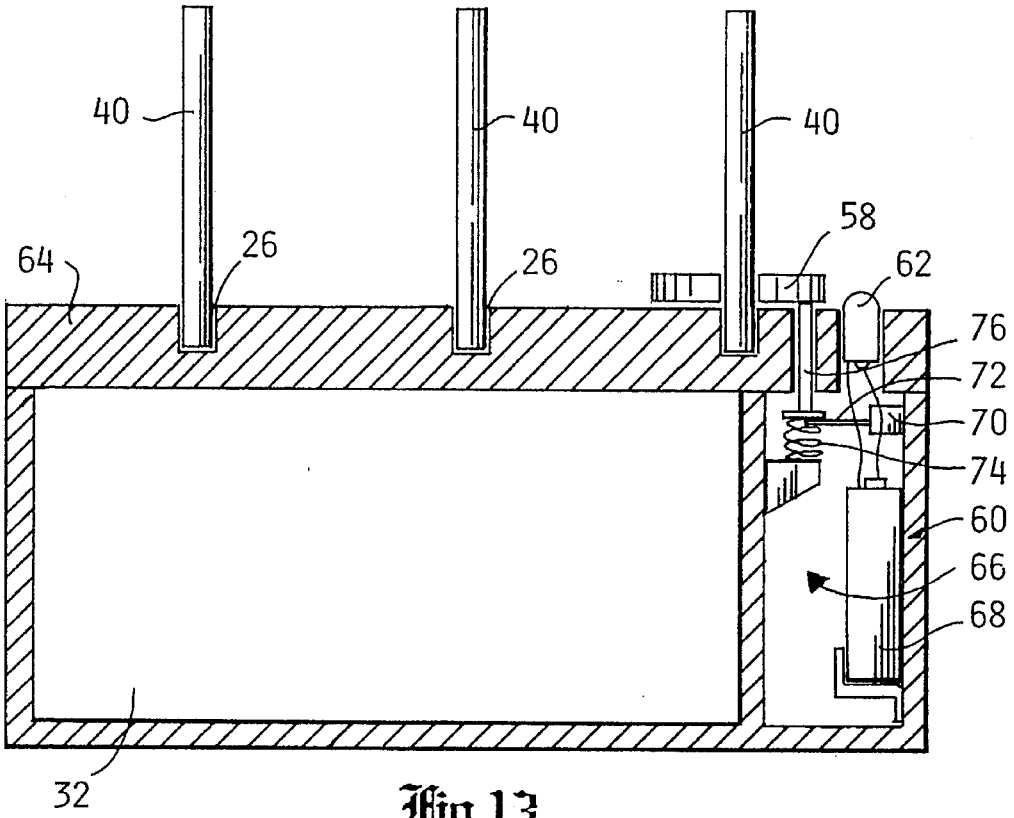
FIG. 13 is a front elevational, sectional view of an enclosure that includes a compartment that houses the electrical circuit.

The game 10 may also be equipped with an electrical circuit 60 that consists of an alarm such as a light emitting diode (LED) or an incandescent light bulb 62, an enclosure 64 that incorporates a compartment 66, a battery 68, a normally open, sensitive switch 70, and a weighted first disk 78 that is, the disk that is finally placed on top of the stack at the conclusion of the game 10. The light bulb, which illuminates when the game is concluded, is attached to the enclosure 64 as shown in FIG. 13. The battery 68 is selected to power the light bulb 62 and the switch 70, is connected in series between the light bulb 62 and the battery 68 as shown in FIG. 12. The switch has a contact arm 72 that is biased in an open direction by a spring 74, as shown best in FIG. 13. The contact arm operates the switch contacts and is located below the disk stack as also shown in FIG. 13. When the weighted disk 58 is placed atop the stack at the conclusion of the game, the weight of the stack overcomes the spring bias on the contact arm and a plunger 76 causes the switch contacts to close which then causes the power from the battery 68 to illuminate the light bulb 62 indicating that the game has been successfully concluded.

Figure 14:
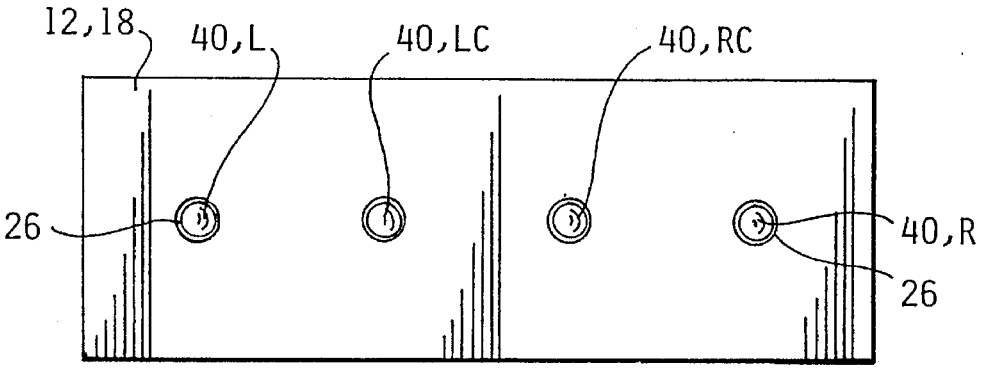
FIG. 14 is a plan view of the strategy game that utilizes four pegs.

The second embodiment of the game 10 differs from the preferred embodiment in that the second embodiment is comprised of a stationary platform 12 having a set of four, spaced-apart peg cavities 26 as shown in FIG. 14. The four peg cavities 26 consist of a right-center cavity, a left-center cavity, a left cavity and a right cavity. Into the right-center cavity is inserted a right-center peg (RC), into the left-center cavity, a left-center peg (LC), into the left cavity, a left peg (L) and into the right cavity, a right peg (R). As with the preferred embodiment, the platform 12 can consist of an enclosure 30 as shown in FIGS. 10 and 11 with the exception that the enclosure is dimensioned to include the seven segments 50 and the four pegs 40 as shown in FIG. 14.

STRATEGY MOVES

The series of strategy moves required to play the game 10 with the three pegs 40, commences by initially stacking the colored disks 52 over the center peg 40 as shown in FIG. 1. The game continues by performing the following strategy moves which concludes with move number 147:

(1) Purple to right peg (R)
(2) Blue to left peg (L)
(3) Purple to L
(4) Aqua to R
(5) Purple to center peg (C)
(6) Blue to R
(7) Purple to R
(8) Green to L
(9) Purple to L
(10) Blue to C
(11) Purple to C
(12) Aqua to L
(13) Purple to R
(14) Blue to L
(15) Purple to L
(16) Yellow to R
(17) Purple to C
(18) Blue to R
(19) Purple to R
(20) Aqua to C
(21) Purple to L
(22) Blue to C
(23) Purple to C
(24) Green to R
(25) Purple to L
(26) Blue to R
(27) Purple to R
(28) Aqua to L
(29) Purple to L
(30) Blue to C
(31) Purple to C
(32) Aqua to R
(33) Purple to L
(34) Blue to R
(35) Purple to R
(36) Orange to L
(37) Purple to L
(38) Blue to C
(39) Purple to C
(40) Aqua to L
(41) Purple to R
(42) Blue to L
(43) Purple to L
(44) Green to C
(45) Purple to C
(46) Blue to R
(47) Purple to R
(48) Aqua to C
(49) Purple to L
(50) Blue to C
(51) Purple to C
(52) Yellow to L
(53) Purple to R
(54) Blue to L
(55) Purple to L
(56) Aqua to R
(57) Purple to C
(58) Blue to R
(59) Purple to R
(60) Green to L
(61) Purple to L

(62) Blue to C
(63) Purple to C
(64) Aqua to L
(65) Purple to R
(66) Blue to L
(67) Purple to L
(68) Red to R
(69) Purple to R
(70) Blue to C
(71) Purple to C
(72) Aqua to R
(73) Purple to L
(74) Blue to R
(75) Purple to R
(76) Green to C
(77) Purple to C
(78) Blue to L
(79) Purple to L
(80) Aqua to C
(81) Purple to R
(82) Blue to C
(83) Purple to C
(84) Yellow to R
(85) Purple to R
(86) Blue to L
(87) Purple to L
(88) Aqua to R
(89) Purple to C
(90) Blue to R
(91) Purple to R
(92) Green to L
(93) Purple to L
(94) Blue to C
(95) Purple to C
(96) Aqua to L
(97) Purple to R
(98) Blue to L
(99) Purple to L
(100) Yellow to C
(101) Purple to R
(102) Blue to C
(103) Purple to C
(104) Aqua to R
(105) Purple to L
(106) Blue to R
(107) Purple to R
(108) Green to C
(109) Purple to C
(110) Blue to L
(111) Purple to L
(112) Aqua to C
(113) Purple to R
(114) Blue to C
(115) Purple to C
(116) Orange to R
(117) Purple to R
(118) Blue to L
(119) Purple to L
(120) Aqua to R
(121) Purple to C
(122) Blue to R
(123) Purple to R
(124) Green to L
(125) Purple to L
(126) Blue to C
(127) Purple to C
(128) Aqua to L
(129) Purple to R
(130) Aqua to L
(131) Purple to L
(132) Yellow to R
(133) Purple to C
(134) Blue to R
(135) Purple to R
(136) Aqua to C
(137) Purple to L
(138) Blue to C
(139) Purple to C
(140) Green to R
(141) Purple to R (142) Blue to L
(143) Purple to L
(144) Aqua to R
(145) Purple to C
(146) Blue to R
(147) Purple to R The series of strategy moves required to play the game 10 with four pegs 40, commences by initially stacking the colored disks 52 over the right-center peg as shown in FIG. 14. The game continues by performing the following strategy moves which concludes with move number 27:

(1) Purple of L
(2) Blue to LC
(3) Aqua to R
(4) Blue to R
(5) Purple to R
(6) Green to L
(7) Yellow to LC
(8) Green to LC
(9) Orange to L
(10) Purple to RC
(11) Blue to LC
(12) Aqua to L
(13) Purple to LC
(14) Red to R
(15) Aqua to RC
(16) Orange to R
(17) Purple to R
(18) Blue to RC
(19) Green to L
(20) Purple to RC
(21) Yellow to R
(22) Green to R
(23) Purple to L
(24) Blue to LC
(25) Aqua to R
(26) Blue to R
(27) Purple to R While the invention has been described in complete detail and pictorially shown in the accompanying drawings it is not to be limited to such details, since many changes and modifications may be made to the invention without departing from the spirit and the scope thereof. Hence, it is descried to cover any and all modifications and forms which may come within the language and scope of the claims.

We claim:

1. A strategy game comprising:

a) a horizontal, stationary platform having a set of three spaced-apart peg cavities consisting of a center cavity, a left cavity and a right cavity, b) a set if three pegs consisting of a center peg, a left peg and a right peg, where said pegs are inserted upright into each of said respective peg cavities, and c) a set of seven disks with each said disk having substantially centered bore therethrough sized to slidably pass through said pegs and with each said disk having a different diameter, where said disks are initially stacked one atop the other over said center peg of said three pegs, with the largest diameter disk being at the bottom of the stack and with the remaining said disks also stacked over said center peg commencing with the next largest diameter disk in a descending diameter order until the smallest diameter disk is located at the top of the stack, where said game is played by performing a series of strategy moves that concludes when the set of seven disks stacked on said center peg are moved and identically stacked on either said left peg or said right of said set of three pegs, where all moves are accomplished without placing a larger diameter disk over a smaller diameter disk, d) an electrical circuit that causes a light to illuminate when said game is concluded by placing the last disk atop the stack, said electrical circuit comprising:

(1) a weighted upper disk, (2) an incandescent light bulb attached to said platform, (3) a battery selected to power said light bulb, and (4) a normally open, sensitive switch connected in series between said light bulb and said battery, where said switch has a contact arm that operates a set of switch contacts and that is located below said disk stack where upon when said weighted disk is placed atop the stack at the conclusion of said game, the weight of the stack via a plunger, causes the switch contacts of said switch to close which then causes said battery power to be applied to and illuminate said light bulb indicating that said game has been successfully concluded.

* * * * *